United States Patent [19]

Burgess

[11] Patent Number: 4,728,307

[45] Date of Patent: Mar. 1, 1988

[54] TROLLING MOTORS FOR BASS BOATS

[76] Inventor: Dennis F. Burgess, Box 142, Henrietta, N.C. 28076

[21] Appl. No.: 901,632

[22] Filed: Aug. 29, 1986

[51] Int. Cl.[4] ..... B63H 25/02

[52] U.S. Cl. ..... 440/7; 114/153

[58] Field of Search ..... 114/144 R, 153; 440/6, 440/7, 54, 112; 74/478, 480 B, 481, 512

[56] References Cited

U.S. PATENT DOCUMENTS

| | | | |
|---|---|---|---|
| 2,997,012 | 8/1961 | Özkök | 440/11 |
| 3,587,512 | 6/1971 | Patterson | 440/54 |
| 3,685,481 | 8/1972 | Mansell | 440/6 |
| 4,226,206 | 10/1980 | Wilson | 440/112 |
| 4,295,385 | 10/1981 | Huttenhow | 74/512 |
| 4,348,193 | 9/1982 | Arndt | 114/153 |
| 4,515,567 | 5/1985 | Wilson | 74/512 |
| 4,527,983 | 7/1985 | Booth | 440/7 |
| 4,529,386 | 7/1985 | Smith | 440/54 |
| 4,569,663 | 2/1986 | Miller et al. | 440/7 |
| 4,610,632 | 9/1986 | Osborne | 440/6 |
| 4,631,034 | 12/1986 | Menne et al. | 440/7 |

*Primary Examiner*—Sherman D. Basinger
*Assistant Examiner*—Edwin L. Swinehart
*Attorney, Agent, or Firm*—Laurence R. Brown

[57] ABSTRACT

An electric trolling motor is journalled by a rotatable shaft into the hull and deck of a fishing boat and a foot control disk on the shaft is positioned on the deck for control of the steering of the boat by a fisherman with both hands employed with a fishing pole. The motor control assembly is simply a motor housing with a shaft extending therefrom for rotatably mounting through the hull of a fishing boat and a disc on the shaft for mounting at deck level for foot control of the shaft rotation by a fisherman in his regular fishing position.

14 Claims, 6 Drawing Figures

TROLLING MOTORS FOR BASS BOATS

TECHNICAL FIELD

This invention relates to electric trolling motors for fishing boats and more particularly it relates to controls for trolling motors by a fisherman without hands when standing in the boat and holding a fishing rod.

BACKGROUND ART

Control systems for electric trolling motors are known in the art. Some of these have attempted to aid a fisherman by providing foot control features. Thus E. Cavin, in U.S. Pat. No. 4,587,388, May 6, 1986 has introduced a remote foot control switch at a fisherman's location for turning on and off the trolling motor. This control system has the deficiency that the direction of trolling cannot be controlled, except by hands on control at the motor location.

J. Booth, in U.S. Pat. No. 4,527,983, July 9, 1985 has introduced a more comprehensive foot control system for electric trolling motors that also controls speed and direction. This depends upon a flexible cable connector from the control box to the motor mount, and includes complex steering controls for the trolling motor. This system is expensive and complex and is difficult to operate and maintain because of the criticality of cable positioning and manipulation.

A further problem of this prior art system is that the cable mechanism need be carefully handled and positioned across the deck of the boats to avoid damage to the cable and to eliminate safety hazards of tripping, etc.

It is therefore a general objective of this invention to provide a simpler low cost foot control system for electric trolling motors that resolves the problems and deficiencies of the prior art.

Other objectives, features and advantages of the invention will be found throughout the following description and accompanying drawings.

DISCLOSURE OF THE INVENTION

This invention substantially simplifies the prior art trolling motor control systems and adds reliability in operation without sacrificing the comprehensive ability to control the trolling motor as to direction and speed by means of a foot control. Thus, a fisherman need not use hands to control the trolling motor.

As a matter of fact this invention provides a simpler and less costly trolling motor configuration than heretofore generally available while at the same time affording the fisherman a foot control medium for direction and speed.

Thus a rotatable foot control pad is supplied for mounting on the boat deck within reach of the fisherman when in fishing position, either sitting or standing. This control pad is directly connected to the electric trolling motor housing by means of a motor position control shaft extending vertically from the motor through the bottom of the fishing boat and rotatable in a suitable bearing affixed in the hull.

A further feature of the invention is that the motor may be lifted and stored close to the boat hull when not used for fishing simply by vertically moving the shaft in the bearing.

BRIEF DESCRIPTION OF THE DRAWINGS

In the various views like reference characters refer to similar features to facilitate comparison.

THE PREFERRED EMBODIMENTS

Figure 1:
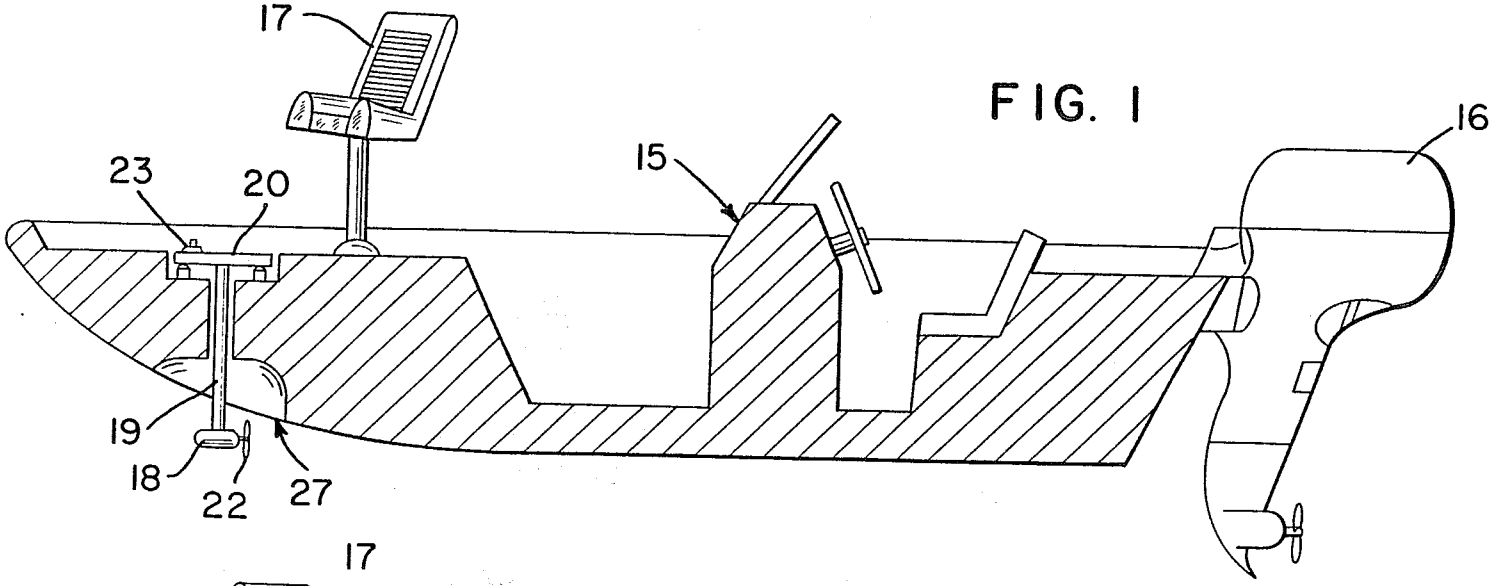
FIG. 1 is a sketch of a partly cut away side view of a bass fishing motor boat embodying the invention.

As may be seen in FIG. 1 the motor boat 15 with the outboard driving motor 16 is of the type sometimes called "bass boats" characterized by a fishing seat 17 above decks near the bow. It is customary when fishing with these boats to have a small electric trolling motor 18 to propell and steer the boat. It is the particular operation of this trolling motor and its mounting in the boat to which this invention is directed.

Figure 2:
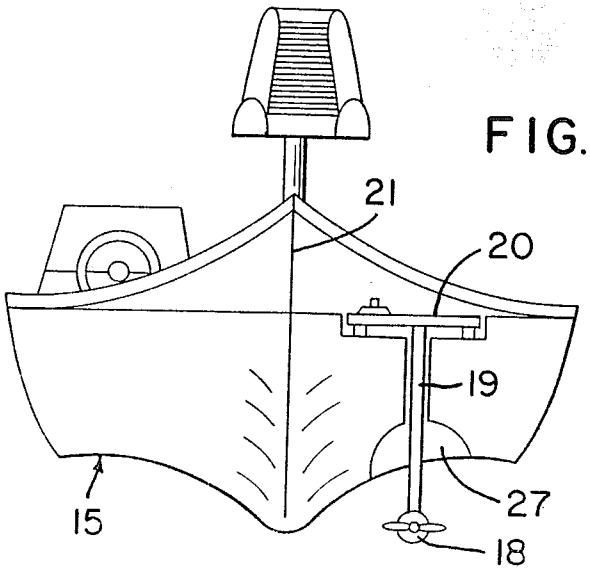
FIG. 2 is a front end view of the boat of FIG. 1.

As may be seen from FIGS. 1 and 2, as diagrammatically shown in cut-away form, the trolling motor 18 has a shaft 19 vertically extending from the motor housing and journalled in the boat to hold the trolling motor 18 horizontally in the water underneath the boat for trolling. A foot control plate 20 is positioned at deck level on one side of the boat center line 21 and near the seat 17 so that a fisherman has access thereto by one foot whether seated or standing. Thus, by foot control the disk 20 may turn the shaft 19 and thus steer the boat when the trolling motor propeller 22 is operating. Also, foot operable controls 23 for starting the motor and for controlling its speed are provided.

Figure 3:
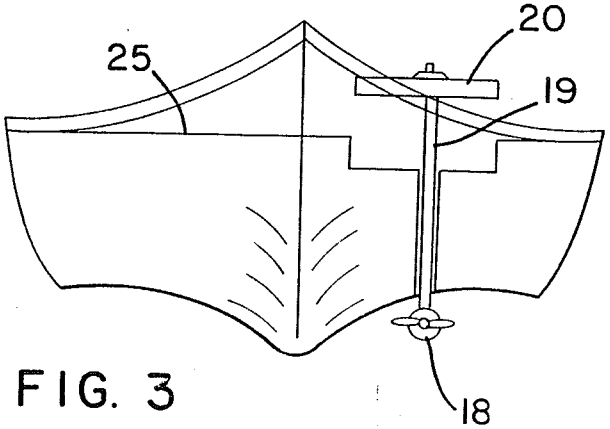
FIG. 3 is a front view of a further boat embodying the invention.

When the trolling motor 18 is not in use, such as when cruising under power from the outboard motor 16, it is preferably raised to the position shown in FIG. 3, wherein the footcontrol disc 20 is positioned above the deck 25 by vertically extending the shaft 19 to position the electric trolling motor 18 adjacent the boat hull bottom. As shown in FIGS. 1 and 2, the boat 15 may have a recessed compartment 27, for receiving the motor, in the manner set forth in U.S. Pat. No. 4,226,206, Oct. 7, 1980 to J. E. Wilson for Retractable Propulsive Means for Small Boats, for example.

Figure 4:
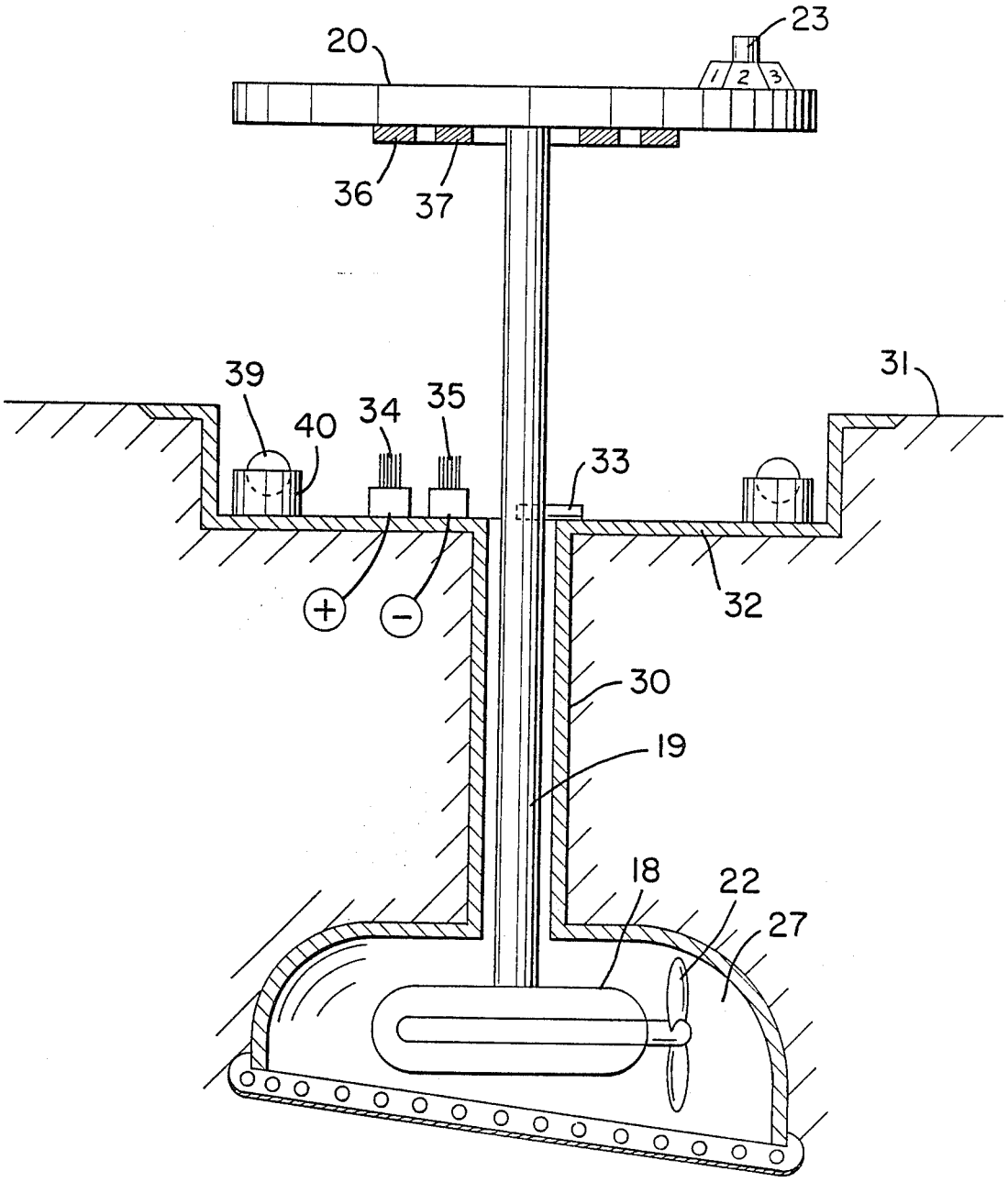
FIG. 4 is an elevation view, partly in section, of a trolling motor assembly embodying the invention positioned in stand by storage position.

FIG. 4 shows a typical trolling motor assembly for installing on a boat in such a manner, having the compartment 27 for receiving the motor-propeller assembly 18–22. The shaft housing 30 has the motor shaft 19 journalled therein for rotation and in this embodiment is fashioned to fit in the recess below deck 31 provided by the cylindrical receptacle 32 for the foot control disc 20. The motor is held up in the stowed position shown by the detent pin 33 in the shaft 30, or equivalent mechanism.

When the motor is lowered into the water in trolling position, the brushes 34, 35 contact slip rings 36, 37 on the foot control disc 20, so that the trolling motor may be turned on and off and its speed controlled by foot contact with the motor control switching means 23.

Only one wire may be necessary if the motor case and shaft and one battery connection are grounded. A control wire cable is run inside shaft 19 from the switching means 23 to the motor housing 18.

Figure 5:
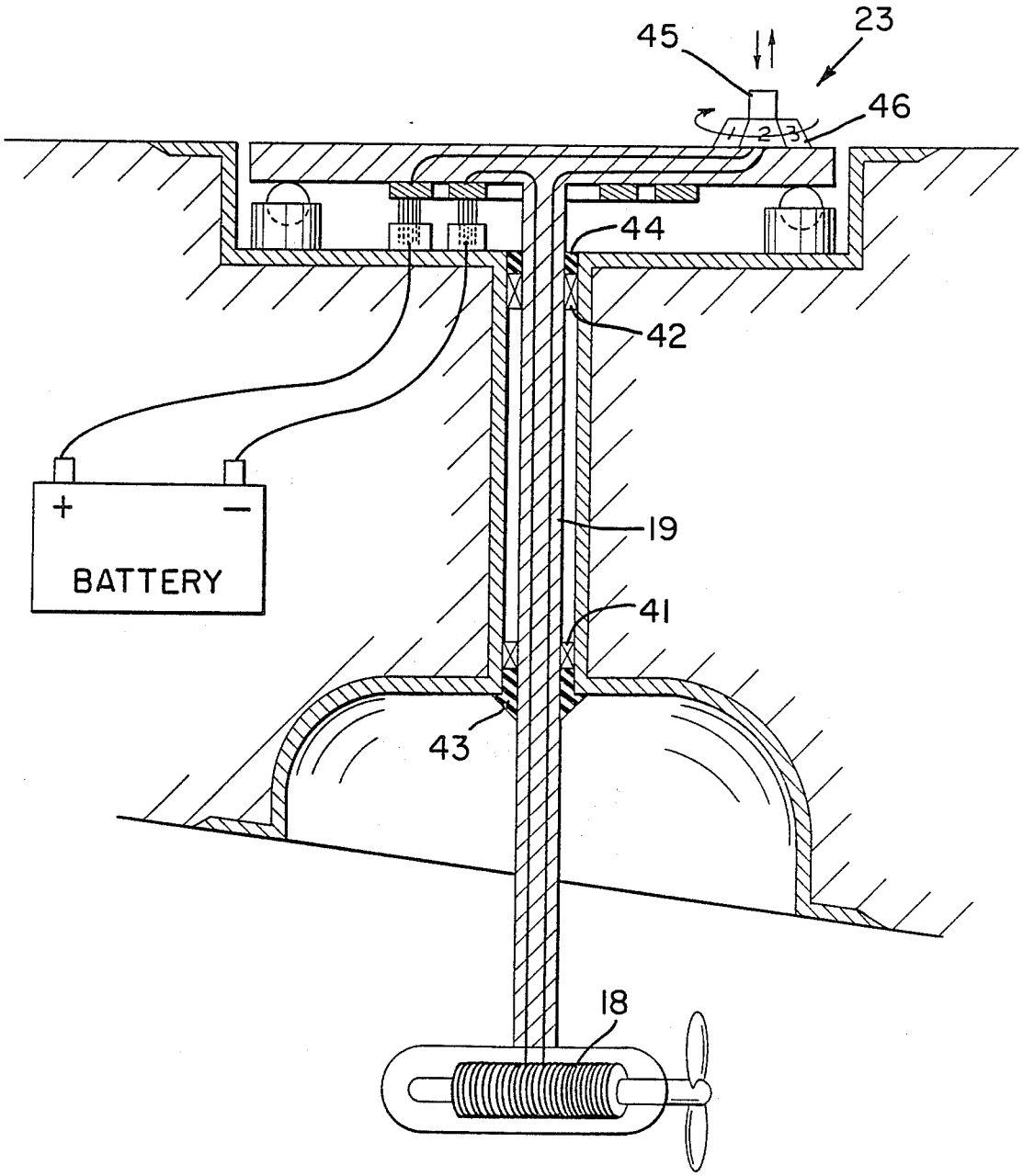
FIG. 5 is a further elevation view embodiment of the invention with the trolling motor assembly shown in operating position.

Note also that a set of roller bearings 39 may be distributed about the receptable in retainers 40 for engaging the bottom side of disk 20 as it is rotated to control the steering of the boat. As better seen from FIG. 5, the shaft 19 is journalled for rotation by bearings 41, 42, and water seals 43, 44 are provided. The motor switching control means 23 may comprise an off-on toggle switch button 45 and a rotatable switching member 46 for connecting in resistors or otherwise controlling the speed of the motor 18.

Figure 6:
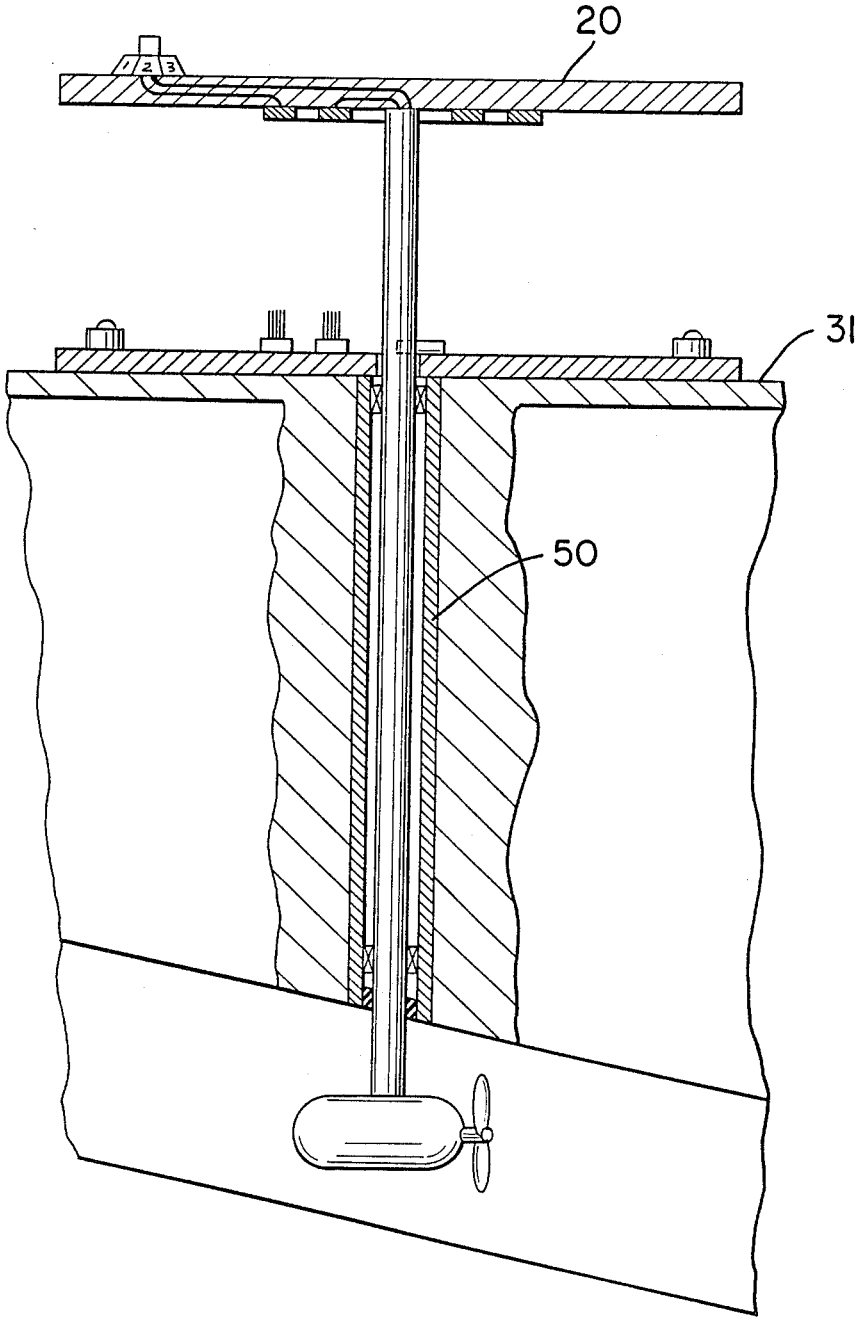
FIG. 6 is an elevation view of a simplified embodiment of the invention comprising a fragmentary section of a boat cut away in section to show the installation of a trolling motor.

In FIG. 6 a simpler construction with a small diameter hole and shaft 50 installed in the deck 31 is shown with the foot control disk 20 extending slightly above the deck level. Note that prior art trolling motors have not been mounted through the hull, nor have foot control disks been mounted directly on a rotatable motor control shaft.

It is therefore evident that this invention has improved the state of the art in bass fishing and trolling by simplifying the nature of trolling motor control by the fisherman and by simplifying and reducing the complexity of the control system for trolling motors. Those novel features descriptive of the nature and spirit of this invention are defined with particularity in the following claims.

I claim:

1. An electric trolling motor for a fishing boat including a deck, the motor being controllable by the foot of a fisherman in the boat, comprising in combination, a motor housing encompassing an electric motor with a propeller drive shaft extending therefrom, a propeller attached to the drive shaft, a motor position control shaft having a first end affixed to the motor housing, the control shaft vertically extending from the motor housing when it is disposed to hold the propeller shaft horizontally in the water for trolling and having a second end spaced axially from the first end, mounting means for rotatively mounting the control shaft through a bottom of the boat so that the motor housing will rotate with rotation of the control shaft, and foot-operable control means directly connected to the second end of the control shaft for rotation therewith and including an upwardly facing surface positioned level with an upper surface of the deck of the boat when the trolling motor is in its operative position to permit rotation of the control shaft and thereby position the direction of the motor housing and propeller drive shaft under the boat in the water by manipulation of the foot-operable control means with the foot of a fisherman, so that the boat may be steered while a fishing rod is held in the hands.

2. A motor as defined in claim 1, further comprising, support means for supporting the control shaft vertically relative to the deck to place the propeller in the water when the trolling motor is in use, and out of the water in a stored, stand-by position when the trolling motor is not in use.

3. A motor as defined in claim 1, further comprising in combination therewith, the fishing boat having a deck and a hull, with the control shaft mounted through the hull, and the deck includes a recess surrounding the control shaft, and bearing means carried in the recess and engaging a lower surface of the foot-operable control means to minimize friction resistance to rotation of the foot-operable control means.

4. A combination as defined in claim 3, wherein the fishing boat is a bass boat having its hull shaped to present along a longitudinal axis a central hull bottom portion for displacing water and being flanked on either side thereof by integral outer hull contour portions for extending above and substantially parallel with the water, wherein the motor control shaft extends through the boat hull at an outer hull region with a control shaft long enough to extend the motor into the water with the foot-operable control means level with the deck and accessible to a standing fisherman's foot, and means supporting the motor vertically to rest in the water and away from the hull in a fishing position and against the hull in a stand by position.

5. A motor as defined in claim 1 mounted in the fishing boat on one side of a center longitudinal line of the boat for access of the foot-operable control means by the foot of a fisherman straddling the center line.

6. A motor as defined in claim 1, wherein the upwardly facing surface of the foot-operable control means is defined by an upper surface of a substantially circular foot control plate connected to the second end of the control shaft and rotatable therewith.

7. A motor as defined in claim 6, wherein the foot control plate includes foot-operable switching means positioned on the upper surface thereof for controlling rotation of the propeller drive shaft.

8. A motor as defined in claim 7, wherein the foot-operable switching means includes a foot-operable on-off switch and a foot-operable propeller drive shaft rotational speed switch.

9. An electric trolling motor for a fishing boat having a deck, the motor mounted on one end of a rotatable position control shaft extending through the hull of the boat in a position accessible by a fisherman, and a foot-operable disc directly mounted on the other end of the position control shaft to control the rotation of the shaft by the fisherman when fishing with both hands on a rod, the foot-operable disc oriented to be recessed in and substantially level with the deck to permit comfortable control of the trolling motor when the fisherman is in both standing and sitting positions.

10. A motor as defined in claim 9, wherein the foot operable disc includes foot-operable switching means positioned on the upper surface thereof for controlling rotation of the propeller drive shaft.

11. A motor as defined in claim 10, wherein the foot-operable switching means includes a foot-operable on-off switch and a foot-operable propeller drive shaft rotational speed switch.

12. An electric trolling motor for a fishing boat having a deck and a recessed housing in the deck, a motor position control shaft extending from the motor for mounting rotatably through the hull of the boat, and a foot-operated control disc directly affixed to the control shaft for rotation of the shaft and motor by a fisherman in the boat, the disc carried in the housing and having an upper surface level with the deck for rotation by the foot of a fisherman.

13. A motor as defined in claim 12, wherein the foot-operated control disc includes foot-operable switching means positioned on the upper surface thereof for controlling rotation of the propeller drive shaft.

14. A motor as defined in claim 13, wherein the foot-operable switching means includes a foot-operable on-off switch and a foot-operable propeller drive shaft rotational speed switch.

* * * * *